US005806103A

United States Patent [19]

McCracken et al.

[11] Patent Number: 5,806,103

[45] Date of Patent: *Sep. 15, 1998

[54] BREAST PROTECTOR AND ASSEMBLY

[75] Inventors: Jamie McCracken; Kathy L. Goff, both of Stillwater, Okla.

[73] Assignee: Youth Education Safety & Sports, Inc., Edmond, Okla.

[ * ] Notice: The term of this patent shall not extend beyond the expiration date of Pat. No. 5,439,409.

[21] Appl. No.: 805,022

[22] Filed: Feb. 21, 1997

Related U.S. Application Data

[63] Continuation of Ser. No. 476,185, Jun. 7, 1995, abandoned, which is a continuation-in-part of Ser. No. 84,046, Jun. 28, 1993, Pat. No. 5,439,409.

[51] Int. Cl.[6] ..... A41C 3/00; A41C 3/12; A41D 13/00

[52] U.S. Cl. ..... 2/455; 2/463; 2/267; 450/57

[58] Field of Search ..... 2/73, 67, 267, 2/268, 463, 464, 465, 455, 456, 2.5; 450/30, 31, 32, 38, 37, 36, 53, 54, 55, 56, 57, 93, 39, 40; 623/7, 8

[56] References Cited

U.S. PATENT DOCUMENTS

| | | | |
|---|---|---|---|
| 1,721,739 | 7/1929 | Kennedy . | |
| 2,495,307 | 1/1950 | Abramson | 128/282 |
| 2,579,365 | 12/1951 | Conde | 2/42 |
| 2,940,453 | 6/1960 | Lerner | 128/454 |
| 3,176,686 | 4/1965 | Barnes | 128/132 |
| 3,478,739 | 11/1969 | Librande | 128/132 |
| 3,532,096 | 10/1970 | Seidl | 128/463 |
| 3,721,997 | 3/1973 | Mundt | 2/46 |
| 3,772,899 | 11/1973 | Novi | 66/176 |
| 4,035,440 | 7/1977 | Khanna et al. | 260/859 R |
| 4,199,825 | 4/1980 | Knoche | 3/36 |
| 4,566,458 | 1/1986 | Weinberg | 128/478 |
| 4,578,821 | 4/1986 | Zufle | 2/2.5 |
| 5,022,887 | 6/1991 | Lawson | 450/54 |
| 5,032,103 | 7/1991 | Larsson | 450/37 |
| 5,180,326 | 1/1993 | Williams | 450/91 |
| 5,244,432 | 9/1993 | Moy Au et al. | 450/54 |
| 5,281,186 | 1/1994 | Buckley et al. | 450/31 |
| 5,439,409 | 8/1995 | McCracken et al. | 2/267 X |

*Primary Examiner*—Jeanette E. Chapman
*Attorney, Agent, or Firm*—Dunlap & Codding, P.C.

[57] ABSTRACT

A breast protector and assembly are provided. The breast protector comprises a retention cup constructed of a rigid or semi-rigid material and formed into a demi-teardrop shape which approximates the natural shape of an unsupported female breast. The retention cup can have padding permanently or removably attached to an inner surface of the retention cup. A breast protector assembly comprises two retention cups fitted into a retention cup sleeve composed of a semi-elastic material in the shape of a tube. The retention cup assembly is sized so that the retention cups fit securely within the tube. The retention cup assembly can fit within the cups of an ordinary brassiere, being held thereby against the body of the wearer. Alternately, the retention cup assembly can be sewn into the brassiere.

19 Claims, 2 Drawing Sheets

BREAST PROTECTOR AND ASSEMBLY

CROSS REFERENCE TO RELATED APPLICATIONS

This is a continuation of application Ser. No. 08/476,185 filed on Jun. 7, 1995, now abandoned. This is a continuation-in-part of co-pending application U.S. Ser. No. 08/084,046, filed Jun. 28, 1993, entitled Breast Protector and Assembly.

FIELD OF THE INVENTION

This invention relates to chest protectors in general and more specifically to breast protectors for cushioning mammary tissue from shocks associated with outdoor and athletic events.

DESCRIPTION OF THE PREFERRED EMBODIMENTS

Figure 1:
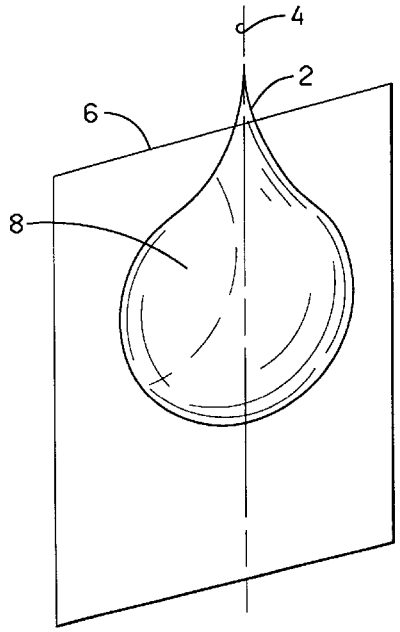
FIG. 1 shows a perspective view of a plane bisecting a teardrop and defining a demi-teardrop shape.

Shown in FIG. 1 is a perspective view of a teardrop 2 suspended in free space. The teardrop 2 has an axis 4 which extends vertically through the teardrop 2 such that the teardrop 2 is symmetrical about the axis 4 at any points on the teardrop 2 bisected by a plane 6 perpendicular to the axis 4. As shown in FIG. 1, the plane 6, which is parallel to the axis 4, defines a section 8 which includes a portion of the teardrop 2. The section 8 comprises a shape which is known herein as a "demi-teardrop shape". The demi-teardrop shape of section 8 approximately defines the shape of an unsupported human female breast.

Figure 2:
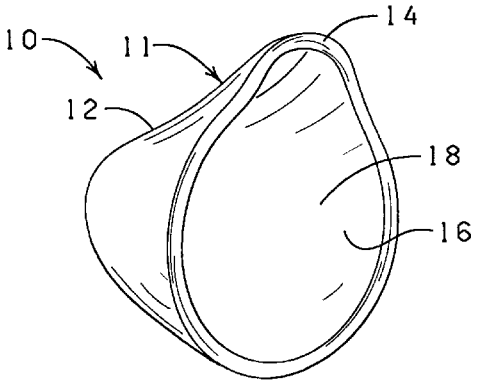
FIG. 2 shows a rear perspective view of a breast protector retention cup constructed in accordance with the present invention.
Figure 3:
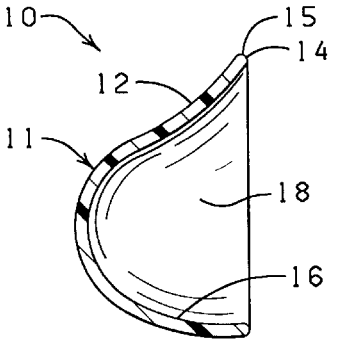
FIG. 3 shows a cut away side view of the retention cup shown in FIG. 2.

Shown in FIGS. 2 and 3 is a demi-teardrop shaped breast protector constructed in accordance with the present invention. The breast protector includes a retention cup generally designated herein with the reference numeral 10. The retention cup 10 has a sidewall 11 defining a generally demi-teardrop shaped cavity 18. The sidewall 11 has an outer surface 12, an inner surface 16, and a periphery 14. The periphery 14 has a rounded lip 15. The retention cup 10 generally defines a demi-teardrop shape, and encloses the generally demi-teardrop shape cavity 18. The rounded lip 15 of the periphery 14 of the sidewall 11 of the retention cup 10 acts to reduce abrasion, chaffing or irritation of the skin of a wearer.

Figure 4:
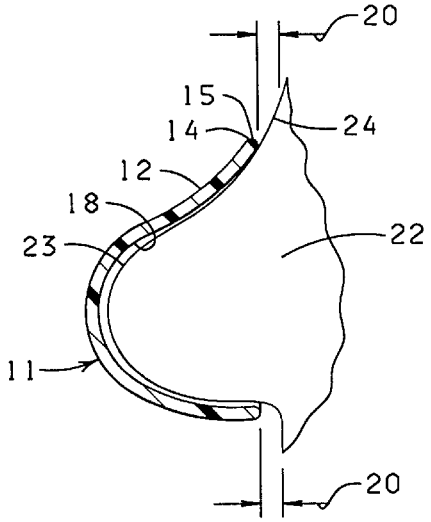
FIG. 4 shows a cut away side view of the retention cup shown in FIG. 2, with a human female breast disposed therein.

FIG. 4 shows the retention cup 10 with a human female breast 22 disposed therein. A surface 23 of the breast 22 is disposed generally adjacent the inner surface 16 of the sidewall 11 of the retention cup 10. The rounded lip 15 of the periphery 14 of the sidewall 11 of the retention cup 10 is disposed a distance 20 away from a torso 24, when a portion of the breast 22 is disposed within the retention cup 10. The distance 20 is significant to the operation of the invention, because when a shock is applied to the retention cup 10, as from a blow, the backward movement of the retention cup 10 against the breast 22 cushions the blow, thereby allowing the breast 22 to act as a "shock absorber". At the same time, the retention cup 10 distributes and diffuses the force over a portion of the breast 22.

Furthermore, the distance 20 between the rounded lip 15 and the torso 24 assists in retarding wearing or chafing of the retention cup 10 against the torso 24. The distance 20 can be any distance sufficient to allow the breast 22 to absorb a force when the force is applied to the breast protector 10.

The retention cup 10 can be constructed, for example, and not by way of limitation, of seventy five percent polyethylene and twenty five percent thermoplastic elastomer. In another embodiment, the retention cup 10 is constructed of dense rubber or foam. However, the retention cup 10 can be constructed of any suitable, rigid or semi-rigid, washable material.

The retention cup 10 is ordinarily fitted into the support cup of a brassiere (not shown) which is thereafter donned by the wearer. The retention cup 10 operates to protect the breast of the wearer partially enclosed therein, while presenting a natural, unconfined appearance.

Figure 5:
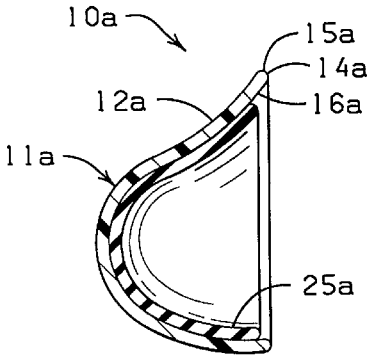
FIG. 5 shows a cut away side view of a retention cup constructed in accordance with the present invention, having padding disposed adjacent the inner surface.

FIG. 5 shows a retention cup 10*a*, constructed in accordance with the present invention. The retention cup 10*a* includes a sidewall 11*a*. The sidewall 11*a* has an outer surface 12*a*, an inner surface 16*a*, and a periphery 14*a*. The periphery 14*a* includes a rounded lip 15*a*. The rounded lip 15*a* of the periphery 14*a* of the sidewall 11*a* operates to reduce abrasion, chaffing or irritation of the skin of the wearer of the retention cup 10*a*.

Padding 25*a* is disposed adjacent the inner surface 16*a* of the sidewall 11*a*. The padding 25*a* can be permanently attached to the inner surface 16*a*, or it may be detachably connected to the inner surface 16*a* of the sidewall 11*a*, so that the padding 25*a* can be removed from the inner surface 16*a* as, for example, to launder the padding 25*a*.

The retention cup 10*a* is worn in exactly the same manner as the retention cup 10 shown in FIGS. 2–4. When the retention cup 10*a* is worn, the periphery 14*a* of the sidewall 11*a* is positioned a distance away from the torso of the wearer so that when shock is applied to the retention cup 10*a*, the force of the shock is distributed and diffused by the retention cup 10*a*, and thereafter the force is transferred to the breast, which deforms, thereby dissipating the force.

Figure 6:
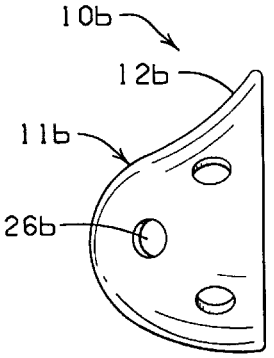
FIG. 6 shows a side view of a retention cup constructed in accordance with the present invention, having a plurality of holes formed in the sidewall.

FIG. 6 shows a side view of retention cup 10*b* constructed in accordance with the present invention. The retention cup 10*b* has a sidewall 11*b*. The sidewall 11*b* has a plurality of holes formed therein, one of the holes being shown and designated by the numeral 26*b*. The holes penetrate the outer surface 12*b* and extend into the interior of the retention cup 10*b*. Other than as stated above, the retention cup 10*b* is constructed and used in exactly the same manner as the retention cup 10.

Figure 7:
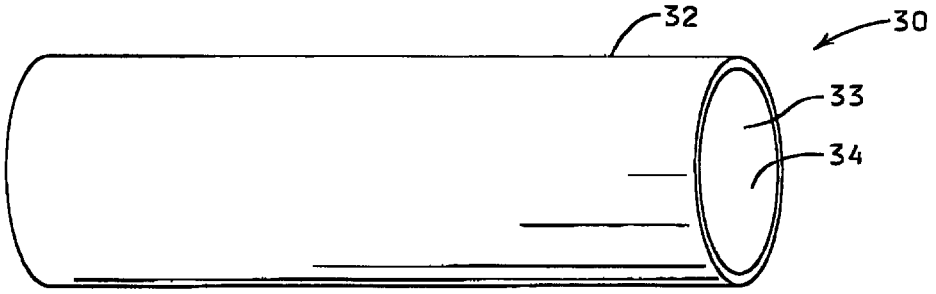
FIG. 7 shows a perspective view of a retention cup sleeve constructed in accordance with the present invention.

FIG. 7 shows a retention cup sleeve 30. The retention cup sleeve 30 has a sidewall 32 defining an annular space 33 having a first end opening 34 and a second end opening 36. The sidewall 32 is composed of a semi-elastic material. The sidewall 32 can be constructed of a cloth material of fifty percent cotton, fifty percent polyester mix, or other suitable materials can be used. The retention cup sleeve 30 is sized to permit the insertion of retention cups 10 into the annular space 33 by way of the first end opening 34 and the second end opening 36, such that the retention cups 10 are held within the retention cup sleeve 30.

Figure 8:
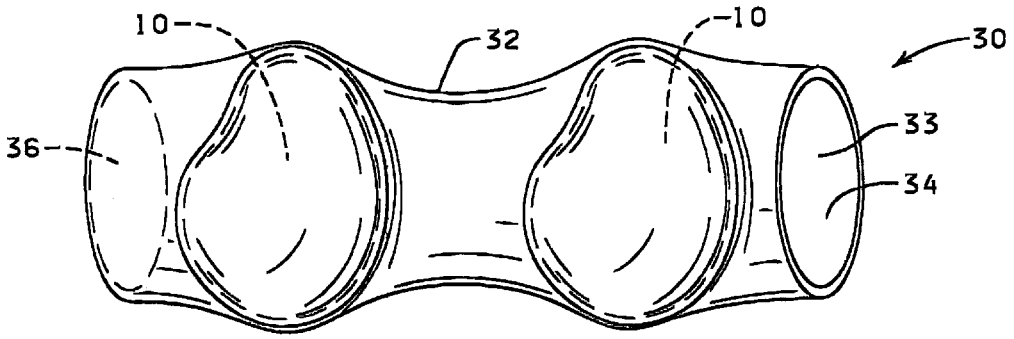
FIG. 8 shows a perspective view of the retention cup sleeve shown in FIG. 7, with two retention cups disposed therein.

Shown in FIG. 8 is the retention cup sleeve 30 with two retention cups 10 disposed in the annular space 33 thereof. The semi-elastic material of the sidewall 32 of the retention cup sleeve 30 can be stretched to assist the placement of the retention cups 10 within the annular space 33.

Each of the retention cups 10, disposed within a portion of the sleeve 30, is subsequently fitted into the support cups of a brassiere. The brassiere can then be worn, with the retention cups 10 fitted within the annular space 33 of the retention cup sleeve 30 providing protection to the wearer against shocks to the breasts, while at the same time, providing a generally natural and unconfined appearance.

Figure 9:
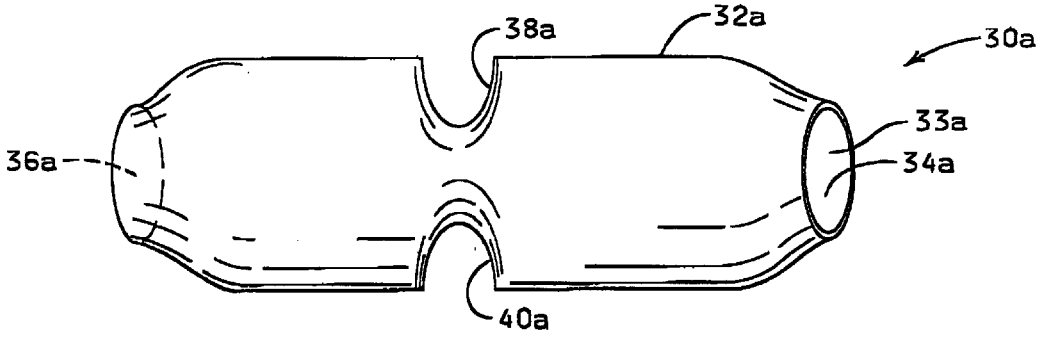
FIG. 9 shows another embodiment of a retention cup sleeve constructed in accordance with the present invention.

Shown in FIG. 9 is another embodiment of the retention cup sleeve, designated by the numeral 30*a*. The sleeve 30*a* includes a sidewall 32*a* defining an annular space 33*a* having a first end opening 34*a* and a second end opening 36*a*.

The sidewall 32*a* is constructed of an elastic or semi-elastic material. The material forming the first and second end openings 34*a*, 36*a* is gathered or tapered to provide restricted access by way of the first and second end openings 34*a*, 36*a* to the annular space 33*a*. Additionally, a first notch 38*a* and a second notch 40*a* are formed in the sidewall 32*a*, generally equidistant between the first end opening 34*a* and the second opening end 36*a*.

Figure 10:
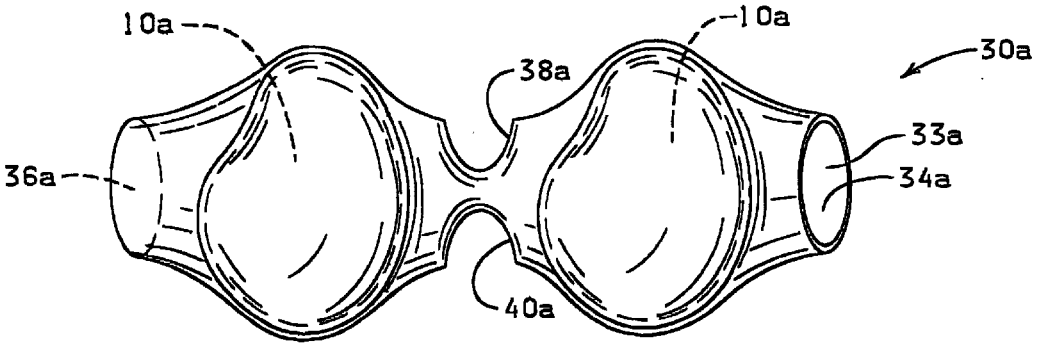
FIG. 10 shows a perspective view of the retention cup sleeve shown in FIG. 9, with two retention cups disposed therein.

Shown in FIG. 10 is the retention cup sleeve 30*a* with two retention cups 10 disposed therein. The gathered or tapered material of the first and second end openings 34*a*, 36*a* cooperates with the first and second notches 38*a*, 40*a* to restrict the lateral movement of the retention cups 10 within the annular space 33*a* of the sidewall 32*a* of the retention cup sleeve 30*a*.

Portions of the retention cup sleeve 30*a* are fitted into the support cups of a brassiere (not shown). The brassiere can then be worn, with the retention cups 10 fitted within the retention cup sleeve 30*a* providing protection to the wearer against shocks to the breasts. Alternatively, the sleeves 30 and 30*a* shown in FIGS. 7 and 9 can be sewn into or otherwise connected to the brassiere such that the ends 34 and 36, or 34*a* and 36*a* respectively, are free to accept retention cups 10.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A female breast protector, comprising:

a retention cup having a sidewall defining a cavity for receiving a portion of a breast which extends outwardly from a torso, the sidewall having an outer surface, an inner surface, and a peripheral edge having no annular lip, the inner surface having detachable padding disposed thereon, the sidewall having a plurality of holes formed therethrough, the sidewall shaped and sized of a smaller diameter than the breast so that the portion of the breast received within the cavity conforms to the contour of the entire inner surface of the sidewall and the peripheral edge remains an effective distance from the torso when the retention cup is supported on the breast and a force is applied to the outer surface of the sidewall whereby the force is distributed over a substantial portion of the breast by the retention cup and the peripheral edge of the sidewall remains spaced a distance from the torso and has no contact with the torso whereby the distributed force is absorbed by the substantial portion of the breast.

2. The breast protector of claim 1 wherein the peripheral edge is rounded, and wherein the detachable padding is disposed in a retention cup sleeve.

3. The breast protector of claim 1 wherein the retention cup is constructed of polyethylene and a thermoplastic elastomer.

4. The breast protector of claim 1 wherein the retention cup is constructed of rubber.

5. The breast protector of claim 1 wherein the retention cup is constructed of plastic foam.

6. A female breast protector, comprising:

a retention cup sleeve connectable to a brassiere, the retention cup sleeve defining an annular space and the retention cup sleeve having at least one opening formed therein; and a pair of retention cups positioned in the annular space of the retention cup sleeve in a spaced apart relationship, each retention cup having a sidewall defining a cavity for receiving a portion of a breast which is extending outwardly from a torso, the sidewall having an outer surface, an inner surface, and a peripheral edge having no annular lip, the inner surface having detachable padding disposed thereon, the sidewall having a plurality holes formed therethrough, the sidewall shaped and sized of a smaller diameter than the breast so that the portion of the breast received within the cavity conforms to the contour of the entire inner surface of the sidewall and the peripheral edge remains an effective distance from the torso when the retention cup is supported on the breast by the retention cup sleeve and the brassiere and a force is applied to the outer surface of the sidewall whereby the force is distributed over a substantial portion of the breast by the retention cup and the peripheral edge of the sidewall remains spaced a distance from the torso and has no contact with the torso whereby the distributed force is absorbed by the substantial portion of the breast.

7. The breast protector of claim 6 wherein the peripheral edge is rounded, and wherein the detachable padding is disposed in a retention cup sleeve.

8. The breast protector of claim 6 wherein the retention cup is constructed of polyethylene and a thermoplastic elastomer.

9. The breast protector of claim 6 wherein the retention cup is constructed of rubber.

10. The breast protector of claim 6 wherein the retention cup is constructed of plastic foam.

11. The breast protector assembly of claim 6 wherein the retention cup sleeve is constructed of a semi-elastic material.

12. The breast protector assembly of claim 6 wherein the retention cup sleeve is provided with a first end opening and a second end opening, each of the first and second end openings communicating with the annular space of the retention cup sleeve such that one of the retention cups is disposable in the annular space of the retention cup sleeve via the first end opening whereby the retention cup is positionable over a portion of one breast and the other of the retention cups is disposable in the annular space of the retention cup sleeve via the second end opening whereby the retention cup is positionable over the other breast.

13. The breast protector assembly of claim 12 wherein the retention cup sleeve is gathered at the first and second end openings and wherein the retention cup sleeve is provided with a first notch and a second notch disposed in the annular space of the retention cup, the first notch and the second notch cooperating with the gathered portion of the retention cup sleeve to restrict lateral movement of the retention cups in the annular space of the retention cup sleeve.

14. A female breast protector, comprising;

a pair of retention cups adapted to be supported in a spaced apart relationship on a pair of breasts which extend from a torso, each retention cup having a sidewall defining a cavity for receiving a portion of one of the breasts, the sidewall having an outer surface, an inner surface, and a peripheral edge having no annular lip, the inner surface having detachable padding disposed thereon, the sidewall having a plurality of holes formed therethrough, the sidewall shaped and sized of a smaller diameter than each breast so that the portion of the breast received within the cavity conforms to the contour of the entire inner surface of the sidewall and the peripheral edge remains a distance from the torso when the retention cup is supported on the breast and a force is applied to the outer surface of the sidewall whereby the force is distributed over a substantial portion of the breast by the retention cup and the peripheral edge of the sidewall remains spaced a distance from the torso and has no contact with the torso whereby the distributed force is absorbed by the substantial portion of the breast.

15. The breast protector of claim 14 wherein the peripheral edge is rounded, and wherein the detachable padding is disposed in a retention cup sleeve.

16. The breast protector of claim 14 wherein the retention cup is constructed of polyethylene and a thermoplastic elastomer.

17. The breast protector of claim 14 wherein the retention cup is constructed of rubber.

18. The breast protector of claim 14 wherein the retention cup is constructed of plastic foam.

19. The breast protector of claim 14 wherein the breast protector is fitted into support cups of a brassiere.

* * * * *